United States Patent [19]

Mühlbach

[11] Patent Number: 4,474,097

[45] Date of Patent: Oct. 2, 1984

[54] SWING BEAM PRESS HAVING A STATIONARY COLUMN

[75] Inventor: Anton Mühlbach, Frankfurt am Main-Sossenheim, Fed. Rep. of Germany

[73] Assignee: USM Corporation, Farmington, Conn.

[21] Appl. No.: 501,965

[22] Filed: Jun. 9, 1983

Related U.S. Application Data

[63] Continuation of Ser. No. 257,901, Apr. 27, 1981, abandoned.

[30] Foreign Application Priority Data

Apr. 29, 1980 [DE] Fed. Rep. of Germany ..... 3016527

[51] Int. Cl.[3] ..... B26D 5/12

[52] U.S. Cl. ..... 83/527; 83/538; 83/639

[58] Field of Search ..... 83/527, 529, 530, 535–538, 83/639

[56] References Cited

U.S. PATENT DOCUMENTS

| | | | |
|---|---|---|---|
| 1,075,064 | 10/1913 | Prime | 83/535 |
| 3,153,965 | 10/1964 | Mühlbach | 83/530 X |
| 3,172,324 | 3/1965 | Hitchcock | 83/538 |
| 3,178,976 | 4/1965 | Kraut | 83/537 X |
| 3,280,685 | 10/1966 | Derrah et al. | 83/529 X |
| 3,543,628 | 12/1970 | Chiesa | 83/639 X |
| 3,854,362 | 12/1974 | Cantella | 83/530 |
| 3,915,044 | 10/1975 | Bley | 83/639 |
| 4,302,998 | 12/1981 | Cantella | 83/535 X |

*Primary Examiner*—Frank T. Yost

*Attorney, Agent, or Firm*—Donald N. Halgren

[57] ABSTRACT

A swing beam press in which the beam is supported on a column which stands up from the machine frame. The column contains a piston-cylinder unit for raising and lowering the beam. The cylinder is formed in the column and a piston rod of the piston projects upwardly out of the column and supports the beam. The beam has a downwards projection which embraces the column to guide the movement of the beam. This construction reduces the friction involved in beam movement and reduces costs.

4 Claims, 1 Drawing Figure

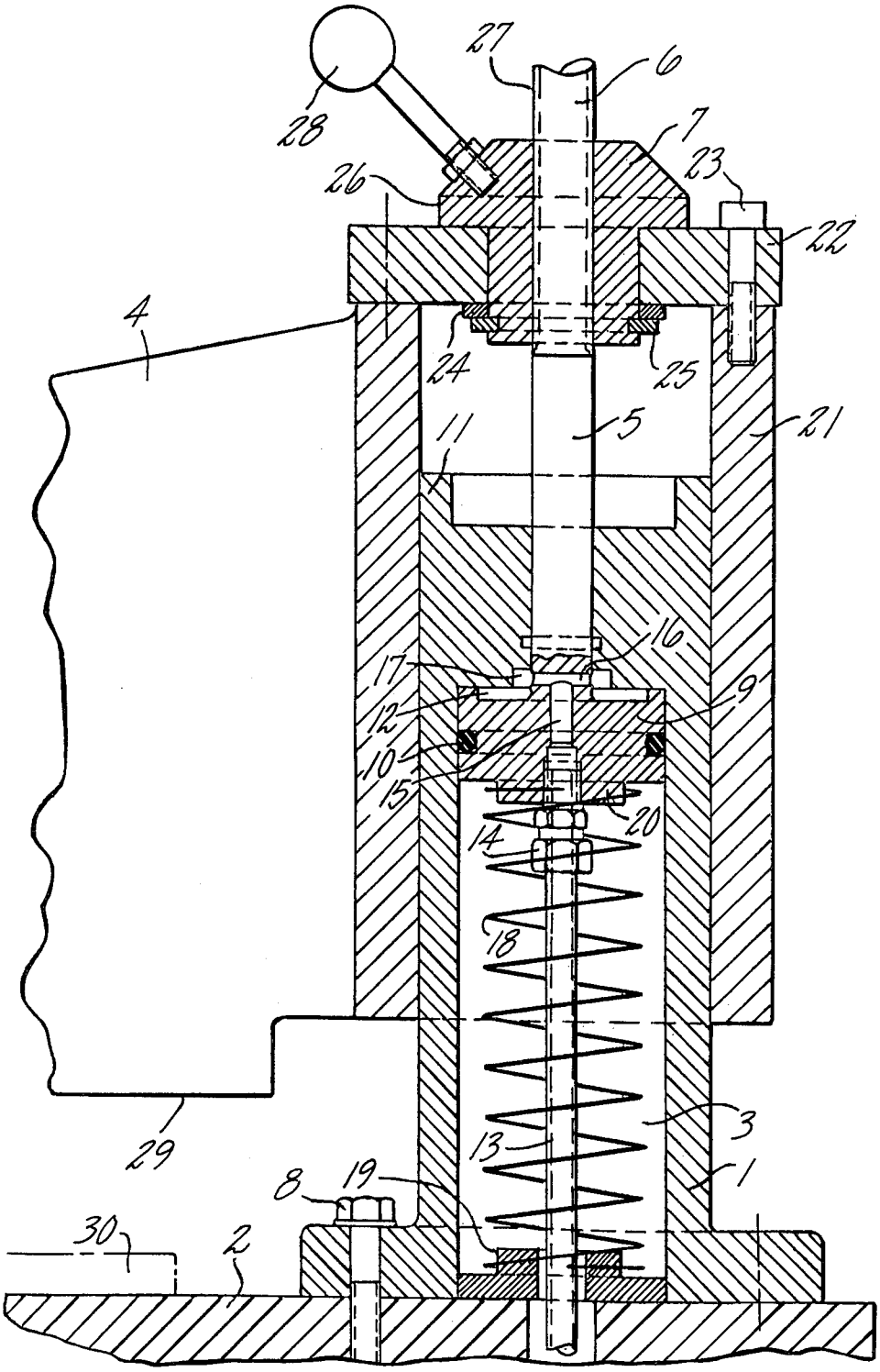
27
6
28
7
23
26
22
4
24
25
5
21
11
16
17
9
12
10
15
20
14
18
3
29
13
1
8
19
30
2

SWING BEAM PRESS HAVING A STATIONARY COLUMN

This application is a continuation, of application Ser. No. 257,901, filed Apr. 27, 1981, now abandoned.

BACKGROUND OF THE INVENTION

The invention relates to a swing beam press having a column supporting the swing beam, the column of which protrudes from the machine frame and embodies in its interior a piston-cylinder unit for initiating the cutting stroke movement of the swing beam extending away from the column.

PRIOR ART

A swing beam press of the general type are known from the German patent application DE-PS No. 1 217 020. In the case of this and other known swing beam presses, considerable effort is required for the cutting operation to overcome inertia, since a column and swing beam are lowered and raised during the cutting operation.

SUMMARY OF THE INVENTION

The present invention involves the simplification of construction of swing beam presses and reduction of their inertia. According to the invention, a column is rigidly mounted to a machine frame and forms the cylinder of a piston-cylinder unit. A piston-rod protrudes out of the upper end of the column and supports the swing beam.

With this construction, the column is no longer a vertically moving structural member, thereby reducing inertia. The overall length that the parts travel is reduced roughly in half when compared to other swing beam presses with ascending and descending columns. By shortening the column, the whole machine construction is simplified. Moreover, the machine does not exert heavy thrusts onto a floor, as is the case with the swing beam presses of the prior art, due to the reduction in inertia. This is particularly relevant with high cutting speeds, since the swing beam ascends and descends in rapid succession.

The construction of the column containing the piston-cylinder unit is designed in such a way that the portion of the piston-rod which protrudes from the column is secured to a slide that encloses the column and maintains a sliding fit for guiding the cutting stroke movement of the swing beam. Due to this construction, the inner and outer walls of the stationary column are used as guides for the swing beam, whereby the beam can take considerable cutting pressures without deflections.

Appropriately, the inside of the column is secured to a radially extending abutment for the piston. In this case, the abutment forms on the one hand the upper end of the column and on the other hand serves as a guide for the piston-rod, onto which the swing beam is attached.

BRIEF DESCRIPTION OF THE DRAWING

The drawing is a side elevational view, partially in cross section, showing the press of the present invention.

DESCRIPTION OF THE PREFERRED EMBODIMENT

The drawing shows a machine table 2 which forms the upper cover of a machine frame. Column 1 is rigidly mounted onto machine table 2 by means of the screws 8. A cylinder 3 is formed within the column 1, the cylinder 3 being a component of a hydraulically-operated piston-cylinder unit. A piston 9 provided with a seal 10 is disposed inside cylinder 3. In the drawing, the piston 9 is shown in its uppermost position, striking abutment 11. Abutment 11 extends radially inside the column 1 and thus blanks off the column towards the top. In the position that is illustrated, the piston 9 leaves a space open for the admission of hydraulic fluid on account of the ring-shaped recess 12 at its front face.

A pipe 13 is provided for the supply of the hydraulic fluid. Pipe 13 is rigidly connected to the piston 9 by means of the union 14. Pipe 13 screwed into the piston 9 runs into the bore 15 in the piston 9, which in turn leads to a horizontal bore 16.

The horizontal bore 16 extends diametrically into the piston-rod 5 and protrudes upwardly out of the piston 9. In the raised position, the end of the horizontal bore 16 is disposed in the region of the cylindrical recess 17 which merges into the ring-shaped recess 12. When hydraulic fluid is pushed into the pipe 13 from below, it flows via bore 15, the horizontal bore 16, the recess 17 and from there to the ring-shaped recess 12. In recess 12 a pressure is applied onto the piston 9 so that the piston extends downwardly inside the cylinder 3. The force of a spring 18 is overcome and enables the piston 9 to return to the upper end position as drawn when it is not put under pressure by hydraulic fluid. The spring 18 is held in the middle of the cylinder 3 by the seating 19. A boss 20 is provided on the underside of the piston 9 for the support of the spring 18 at that end.

A swing beam 4 is disposed on the slide 21 which, in turn, is connected to piston-rod 5. The swing beam 4 extends from the slide 21 and slides up and down as column 1 reciprocates. A cover 22 is attached to slide 21 by means of the screws 23. An adjustment nut 7 is attached to cover 22 such that it can be turned but not displaced axially. This is effected by a washer 24 which is secured onto the adjustment nut 7 by a clip 25 and by a shoulder 26 on the adjustment nut 7. The adjustment nut 7 is provided with an internal thread into which the piston-rod 5 is screwed, the latter being provided with a matching thread 27. A handle 28 protrudes out of the adjustment nut 7 and allows turning of the adjustment nut 7 relative to the cover 22, whereby the piston-rod 5 is moved either upwardly or downwardly by means of the direction of rotation of its adjustment nut 7, whereby the rest position of the swing beam 4 can be optionally set.

With the movement of the piston 9 and the respective following of the piston-rod 5, a very accurate guidance is provided for the swing beam 4 since slide 21 is guided by the column 1 over a greater length. Furthermore, guidance is also additionally facilitated by the abutment 11 which provides a close fit with the piston-rod 5. Moreover, inertia moments that originate from a moving column on swing beam presses are eliminated since a substantially reduced mass is reciprocated on the swing beam press of the present invention. Moreover, the cutting stroke mechanism for the swing beam 4 is housed inside the column 1 and above the machine table 2, so that access to the interior of the machine frame is provided. The parts do not have to travel long distances thereby providing simplicity in design.

Having thus described my invention and what I claim as new and desire to secure as Letters Patent of the United States is:

1. A swing beam press machine comprising a column for the swing beam, which column projects from a frame of the machine and contains therewithin a piston and cylinder unit for effecting the stroke movement of the swing beam which extends away from the column, wherein:

the column is fixedly mounted on the machine frame and forms the cylinder for the piston and cylinder unit having a piston rod which extends through an upper abutment of the cylinder and projects out of the upper end of the column and connects to the swing beam;

the connection between the piston rod and the swing beam consists of a sleeve which slides on the outer wall of the column, and which has a cover closing off the sleeve, which cover is secured to the piston rod.

2. A swing beam press machine as recited in claim 1, wherein the upper abutment is in the form of a counter stop for the piston, which piston is biased by a spring therebeneath.

3. A swing beam press machine as recited in claim 2, wherein a chamber recess is defined between the piston and the upper abutment, so that the piston effectuates a downward pulling force on the swing beam when the chamber recess is pressurized by means of a pressurized fluid supply which is connected to the piston and extends therethrough.

4. A swing beam press machine as recited in claim 3, wherein the piston rod is secured to the cover of the sleeve by an adjustable nut for setting the upper limit position of the swing beam, and into which nut, the piston rod is threadably received, the nut being mounted for rotatable movement relative to the cover.

* * * * *